US006209237B1

(12) United States Patent
Heiple et al.

(10) Patent No.: US 6,209,237 B1
(45) Date of Patent: Apr. 3, 2001

(54) MATERIAL HANDLING ASSEMBLY FOR EXCAVATING MACHINES AND THE LIKE HAVING IMPROVED COMPONENT STORAGE MEANS

(75) Inventors: Ashley Heiple, Alum Bank; Don Keller, Bedford, both of PA (US); Samuel S Pratt, Cumberland, MD (US)

(73) Assignee: Rockland Inc., Bedford, PA (US)

( * ) Notice: Subject to any disclaimer, the term of this patent is extended or adjusted under 35 U.S.C. 154(b) by 0 days.

(21) Appl. No.: 09/366,576

(22) Filed: Aug. 4, 1999

(51) Int. Cl.[7] ..... E02F 3/76

(52) U.S. Cl. ..... 37/406; 414/722

(58) Field of Search ..... 37/301, 302, 403, 37/406, 405, 903, 466, DIG. 12, 468; 414/704, 722, 724, 740, 723; 172/311, 272

(56) References Cited

U.S. PATENT DOCUMENTS 4,375,345 * 3/1983 Hanson ..... 37/406 X
4,660,654 * 4/1987 Wiebe et al. ..... 172/311
5,111,602 * 5/1992 Risch ..... 37/903 X
5,553,408 * 9/1996 Townsend ..... 37/406
5,678,332 * 10/1997 Hawkins ..... 37/403

* cited by examiner

*Primary Examiner*—Robert E. Pezzuto
(74) *Attorney, Agent, or Firm*—Lalos & Keegan; Michael N. Lau

(57) ABSTRACT

An assembly mountable on a maneuverable handle of a machine for performing various earth working and material handling functions generally consisting of a first implement pivotally mountable on the handle; a second implement pivotally mountable on the handle, cooperable with the first implement when the implements are mounted on the handle and angularly displaceable between extended, operable positions and a retracted, storage position; a bracket mountable on the handle, an extendable assembly operatively interconnecting the bracket and the second element; and devices disposed on the bracket engageable with the second implement for releaseably retaining the second implement in the storage position.

25 Claims, 3 Drawing Sheets

MATERIAL HANDLING ASSEMBLY FOR EXCAVATING MACHINES AND THE LIKE HAVING IMPROVED COMPONENT STORAGE MEANS

This invention relates to a material handling assembly mountable on the handle of a machine, and more particularly to such an assembly operable to a clamp, grasp or grapple material between a pair of members. The invention further contemplates an improved arrangement for securing a component of such assembly in a stored position permitting the other component of the assembly to operate independently.

BACKGROUND OF THE INVENTION

In the prior art, there has been developed an implement commonly referred to as a "thumb" mountable on the underside of the handle of an excavating machine which is operable independently to perform various work functions or in cooperation with the bucket of the machine for grasping material between the thumb and the bucket. Typically, the thumb is fixed relative to the handle of the machine and the bucket may be curled and uncurled to grasp material being handled. The thumb also is usually connected to the handle with a strut which may be either of a fixed or extendable length to permit adjustment of the angle of the thumb relative to the handle. The strut may consist of a rigid link detachably securable to one of a number of brackets disposed on the underside of the handle or a hydraulic cylinder assembly, the length of which may be varied between a fully extended position, a fully retracted or stored position adjacent the underside of the handle or a position therebetween.

In such an arrangement, it is desirable to be able to readily retract the thumb to the storage position to permit the bucket to be operated independent of the thumb, reliably secure the thumb in the storage position while the bucket is being operated, quickly and easily release the thumb and readily reposition it to a desired angle relative to the handle to cooperate with the bucket to perform material handling operations. It further is desirable to be able to reposition the thumb between selected operable positions and the storage position and to lock and release the thumb in the storage position, from the operator's station on the machine. It thus is the principal object of the present invention to provide such an assembly which may be operated in the manner described.

SUMMARY OF THE INVENTION

The present invention provides a thumb assembly which may be remotely controlled from the operator's station on the machine, generally consisting of a first implement pivotally mountable on the handle of the machine, a second implement pivotally mountable on the handle of the machine and cooperable with first the implement when the implements are mounted on the handle of the machine, angularly displaceable between extended, operable positions and a retracted, storage position, a bracket mountable on the handle, an extendable assembly operatively interconnecting the bracket and the first implement, remotely operable by the machine operator to set the angle of such first implement relative to the machine handle, and means disposed on the bracket engageable with the first implement and also remotely operable by the machine operator for releasably retaining the second implement in the storage position. The releasable retaining means comprises either a mechanical latch which may engaged or tripped by the operation of the extendable means or an electromagnetic device which may be energized or be energized by suitable control means provided at the machine operators station.

DESCRIPTION OF THE PREFERRED EMBODIMENTS OF THE INVENTION

Figure 1:
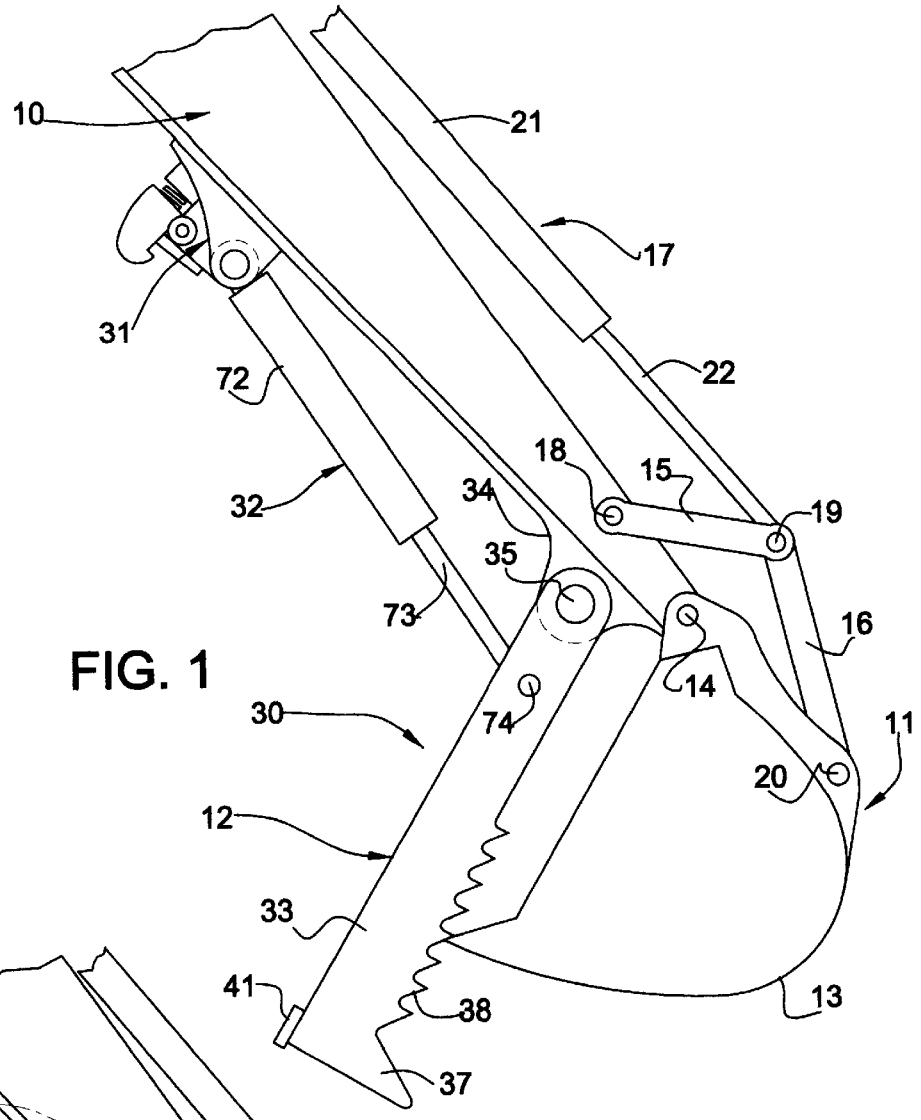
FIG. 1 is a front end assembly of an excavating machine incorporating an embodiment of the present invention, illustrating a thumb component thereof in an operative position cooperating with a bucket component thereof.
Figure 2:
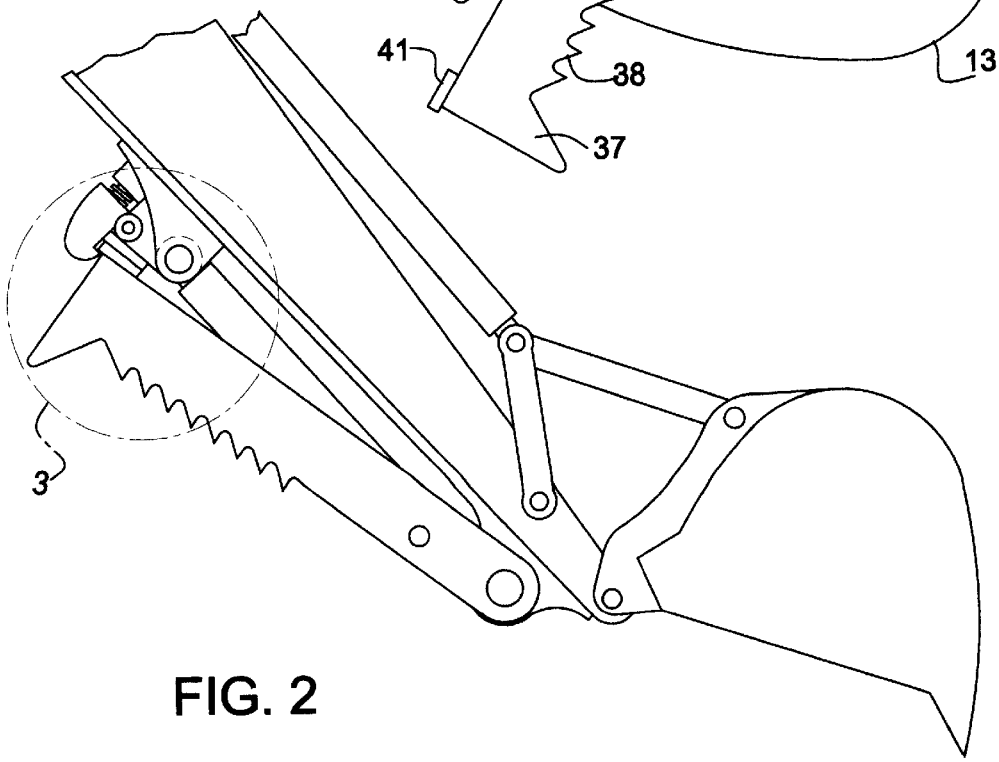
FIG. 2 is a view similar to the view shown in FIG. 1, illustrating the thumb component thereof in a fully retracted, storage position and the bucket component thereof in a fully uncurled position.
Figure 3:
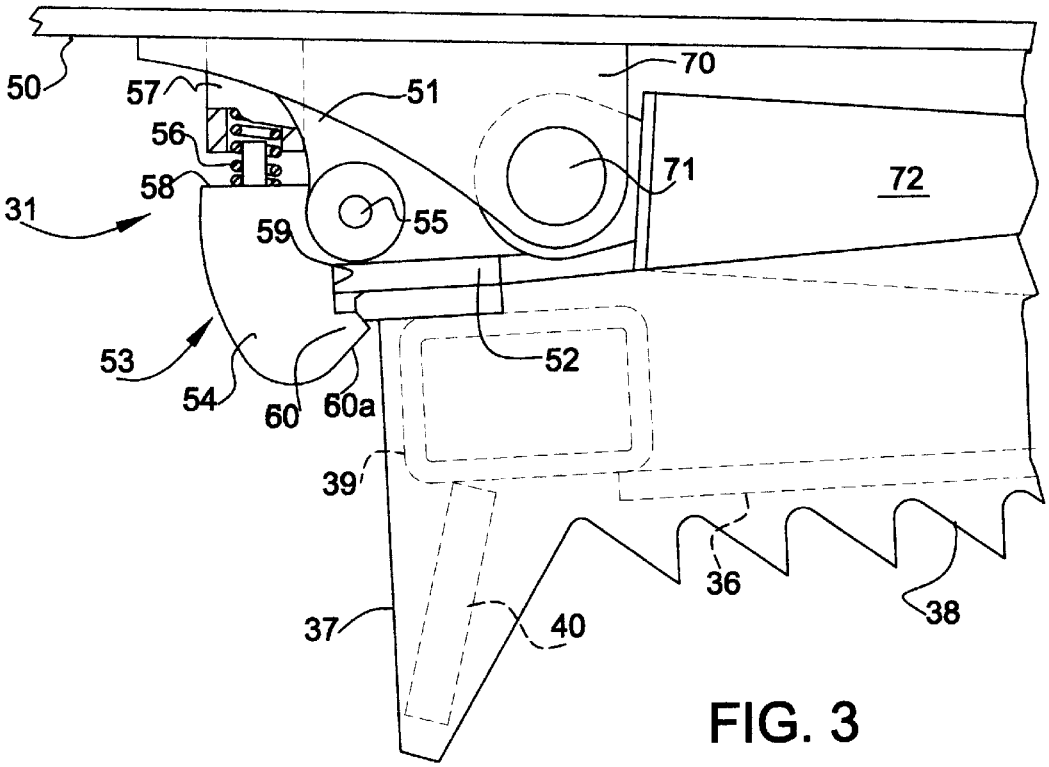
FIG. 3 is an enlarged view of a portion of FIG. 2 designated by the numeral 3 having a portion thereof broken away.

FIGS. 1 through 3 illustrate a front end assembly of a machine embodying the present invention which includes a handle 10, a bucket assembly 11 mounted on the handle and a thumb assembly 12 also mounted on the handle and cooperating with the bucket assembly for grasping, transporting and depositing various materials such as soil, rocks, rubble, tree trunks, tree stumps, debris and the like. Handle 10 is supported on the frame of the machine and may be trained and elevated about vertical and horizontal axes in the conventional manner. Bucket assembly 11 consists of a bucket 13 pivotally connected to the end of the handle by means of a shaft 14 and an actuating assembly consisting of a support link 15, a connecting link 16 and a hydraulic cylinder assembly 17. Support link 15 is pivotally connected to the handle by means of a connecting pin 18, and connecting link 16 is connected to the support link at one end by means of a connection pin 19 and is connected at the other end thereof to the bucket by means of a connecting pin 20. Cylinder assembly 17 is of a conventional construction consisting of a cylinder member 21 pivotally connected at its base end to a bracket mounted on the upper side of the handle, and a rod member 22 connected at its free end to its connecting pin 19. It will appreciated that cylinder assembly 17 may be operated by suitable controls located at the operator's station on the machine to extend rod member 22 and thus pivot or curl the bucket to the position shown in FIG. 1, and retract the rod member and pivot or uncurl the bucket to the position shown in FIG. 2.

Thumb assembly 12 generally includes an arm member 30 mounted on the underside of the handle adjacent the pivotal connection of the bucket to the handle, a bracket 31 also mounted on the underside of the handle and spaced from the connection of the arm member to the handle, and a hydraulic cylinder assembly 32 operatively interconnecting bracket 31 and arm member 30. Arm member 30 consists of a pair transversely spaced, side wall sections 33,33 pivotally connected to a bracket 34 mounted on the underside of the handle by means of a connecting pin 35 and a front end plate section 36 as best seen in FIG. 3. Each of the side wall sections is provided with a projecting, pointed portion 37 at the free end thereof and an adjacent jagged or serrated portion 38. The free ends of the side wall sections further are secured together and reinforced by a boxed shaped member 39 and a plate member 40. In addition, the rear end edges of the side wall members are provided with a transversely disposed trip plate 41 which projects slightly beyond the ends of the side wall sections and is engageable with bracket 31 when the arm member is disposed in a storage position adjacent the underside of the handle as shown in FIGS. 2 and 3.

Bracket 31 is provided with a base plate section 50 secured to the underside of the handle by welding or bolting, a pair of transversely spaced, depending side wall sections 51,51 and a transversely disposed, lower plate section 52 which is adapted to be engaged by trip plate 41 when the arm member is in its fill retracted, storage position as shown in FIGS. 2 and 3. The arm member is releaseably retained in the storage position as shown in FIG. 3 by means of a latch mechanism 53 supported on the bracket and engageable with trip plate 41. The mechanism includes a latch member 54 pivotally mounted on a transversely disposed shaft 55 support on bracket side wall sections 51,51 and spring 56 disposed between a housing 57 depending from base plate section 50 and a rear edge 58 of the latch member. The opposite end of the latch member includes an edge portion 59 which is adapted to engage a rearwardly disposed edge of plate section 52 under the biasing action of spring 56, and protruding portion 60. The latch member is designed so that when the arm member is in the storage position as shown in FIG. 3 with trip plate 41 engaging lower plate 52 of bracket 31, projecting portion 60 of the latch member will engage the protruding end of trip plate 41 and urge it against lower plate section 52 under the biasing force of spring 56. Projecting portion 60 of latch member 54 further is provided with a surface 60*a* which may be engaged by the projecting portion of trip plate 41 as the arm member is pivoted rearwardly into its storage position to cam or trip the latch member, causing it to rotate in a clockwise direction relative to FIG. 3 against the biasing action of spring 56 to permit the trip plate to bypass projecting portion 60 of the latch member, into engagement with lower plate section 52. As the trip plate passes projecting portion 60 and engages bottom plate section 52, the biasing action of the spring will cause the latch member to rotate in a clockwise direction relative to FIG. 3 to the position shown therein securing the arm member in the storage position.

Also secured to and depending from base plate section 50, between side wall sections 51,51 is a pair transversely spaced mounting brackets 70,70. The forward ends of such brackets are provided with a transversely disposed connecting pin 71.

Cylinder assembly 32 is of a conventional construction consisting of a cylinder member 72 pivotally connected at its base end to connecting pin 71 and a rod member 73 pivotally connected at the front end thereof to the arm member by means of a connecting pin 74. It will be appreciated that by operating the cylinder assembly in the conventional manner, arm member 33 may be fully retracted to a storage position as shown in FIG. 2 and extended to a variety of positions angularly disposed relative to the handle including a fully extended position as shown in FIG. 1. When the arm member is in the fully retracted or storage position as shown in FIGS. 2 and 3, the cylinder assembly is adapted to be received at least partially between the side wall sections of the arm member to position the arm member close to the handle to avoid interference with the operation of the bucket being operated independently of the arm member and further to protect the cylinder assembly during the independent operation of the bucket.

Under normal conditions, the arm member is disposed in the storage position as shown in FIGS. 2 and 3, permitting the bucket to be curled and uncurled in the conventional manner to perform digging operations. Under such conditions, the spring force of the latching mechanism is sufficient to carry the load of the arm member and the cylinder assembly, thus effectively retaining the arm member in the storage position. As the bucket is operated to perform various digging functions, the arm member will not only be secured to the underside of the handle to avoid interference with the bucket operation but will shield the cylinder assembly from contact with the bucket or any other object which might damage the assembly. When it is desired to utilize the thumb assembly in cooperation with the bucket to handle various materials by grasping them between the bucket and the arm member, the operator merely operates certain controls at the operator's station to extend the rod member of the cylinder assembly and correspondingly angularly displace the arm member to the desired angle relative to the handle. As the rod member is extended causing the arm member to pivot, trip plate 41 on the end of the arm member will cause the latch member to rotate in a clockwise direction about pin 55, against the biasing action of spring 56, to release the arm member and permit it to be angularly displaced to the desired position. Once the arm member has been set at the desired angle relative to the handle, the bucket may be operated to curl and uncurl and thereby grasp and transport various materials.

Figure 4:
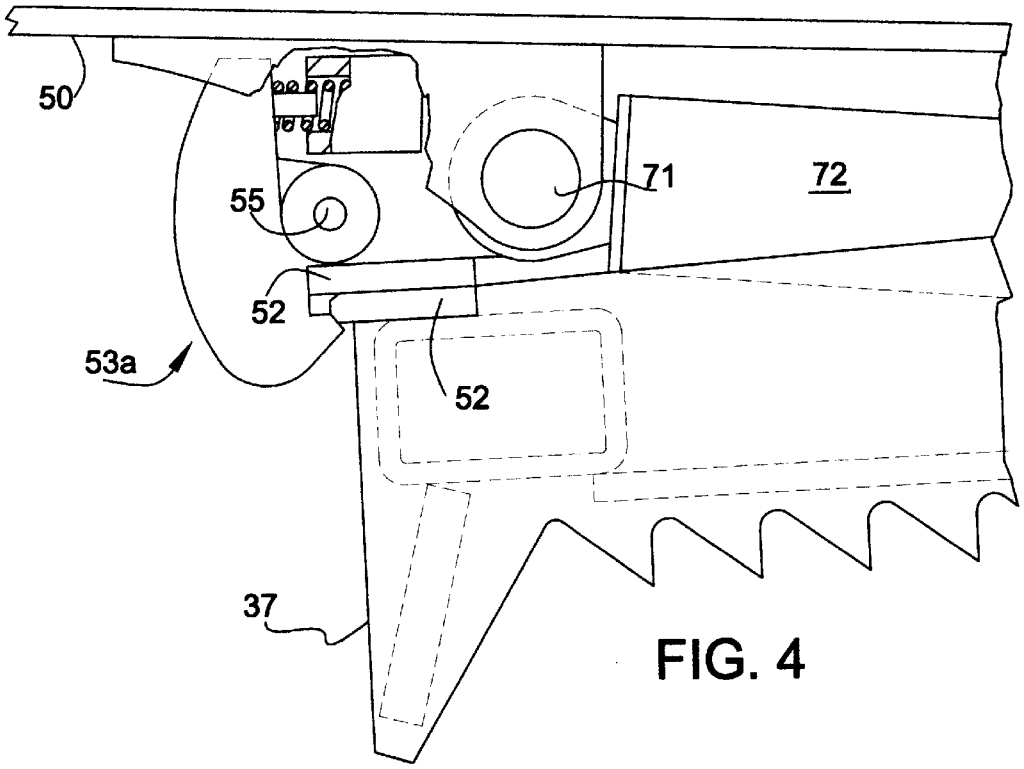
FIG. 4 is a view similar to the view shown in FIG. 3, illustrating a modification of the embodiment shown in FIGS. 1 through 3.

The embodiment shown in FIG. 4 is similar in construction and operation to the embodiment shown in FIG. 3 with the exception of the latch mechanism differing slightly. In lieu of the spring force being directed downwardly against a substantially horizontal edge of the latch member, it is directed rearwardly against a substantially vertical surface of the latch member. In all other respects, the arrangement shown in FIG. 4 is constructed and operates similarly to the arrangement shown in FIG. 3. In each arrangement, the spring force biases the latched member in the latched condition, retraction of the rod member of the cylinder assembly causes the arm member to retract to the storage position thereby engaging and camming the latch member rearwardly to permit the trip plate to pass over the protruding portion of the latch member and engage the lower plate section of bracket 31, the spring force biases the latch member in a counterclockwise direction relative to FIGS. 3 and 4 to retain the arm member in the storage position, and the extension of the rod member of the cylinder assembly permits the trip plate of the arm member to trip the latch member against the biasing action of the spring as the arm member is angularly displaced to an operating position. In both arrangements, the force provided by the spring is sufficient to carry the load imposed on the latch member by the weight of the arm member and cylinder assembly. In both arrangements, the fluid supply means for the cylinder assembly may be provided with suitable controls to lock the rod member in various extended positions, correspondingly positioning the arm member at various angles relative to the handle.

Figure 5:
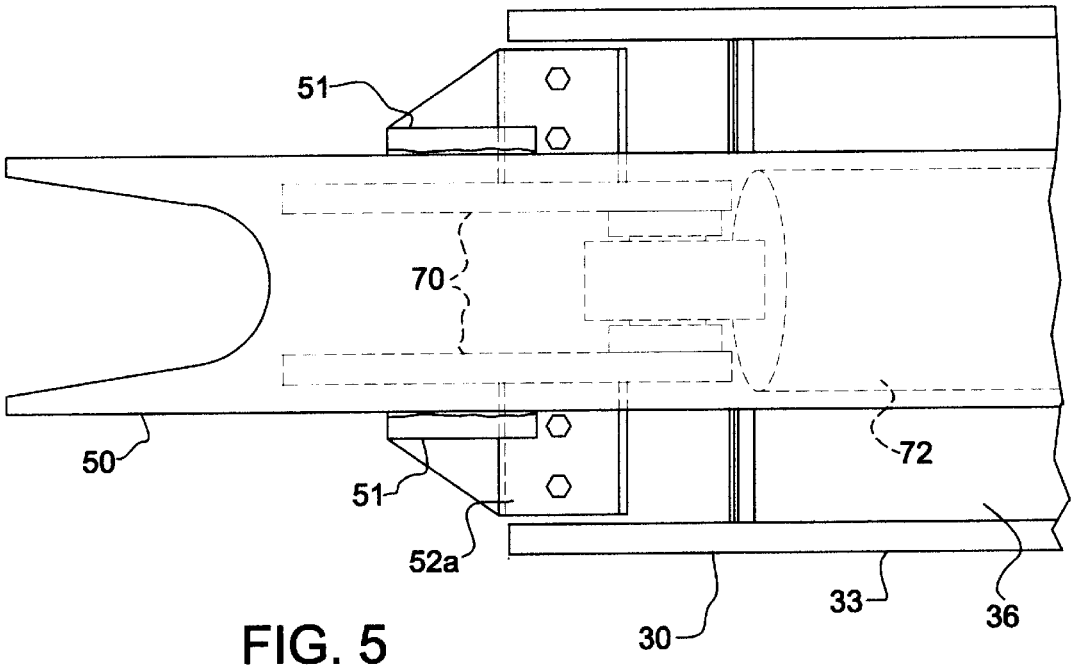
FIG. 5 is a partial top plan view of another modification of the invention shown in FIGS. 1 through 3.
Figure 6:
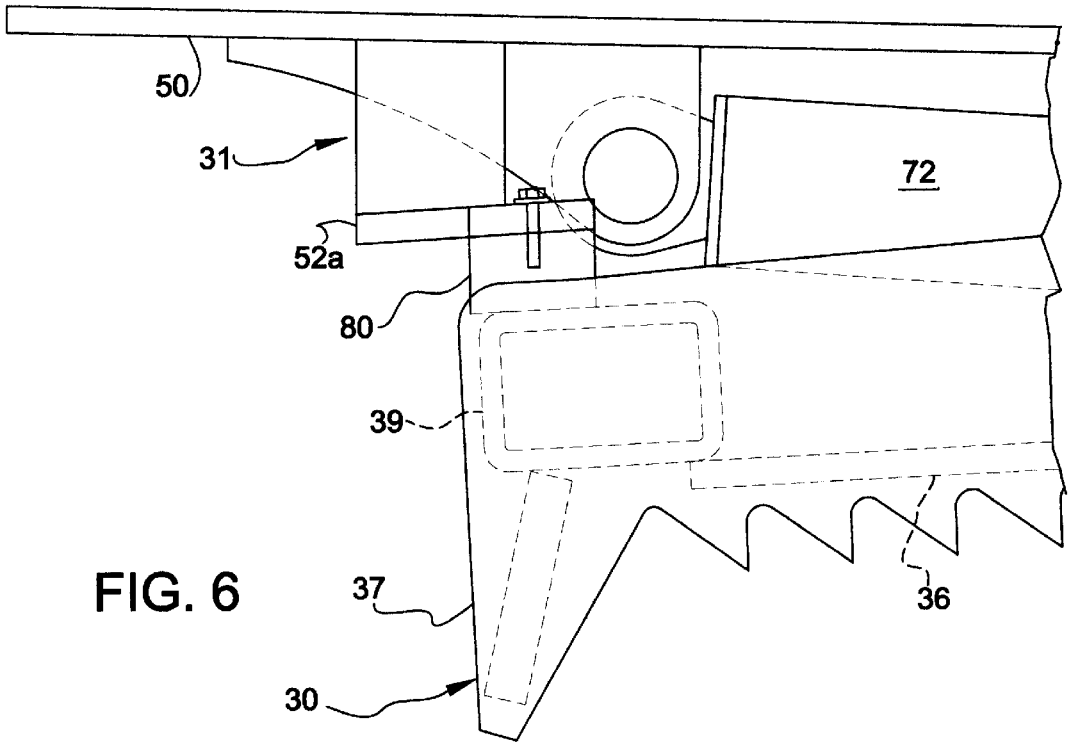
FIG. 6 is a side elevational view of the modification shown in FIG. 5.

FIGS. 5 and 6 illustrate a further embodiment of the invention in which the arm member is retained in the storage position by magnetic means in lieu of a latch mechanism. Here also, the arrangement is similar in construction and operation to the previously described embodiments with the exception of the means provided for retaining the arm member in the storage position. The magnetic means comprises and electromagnet 80 secured to and depending from lower plate section 52*a* of bracket 31. The electromagnet is electrically connected to an electrical power source on the machine and is provided with an on/off switch to permit the energization and deenergization of the electromagnet. The power source may comprise a conventional 12-volt DC battery. As shown in FIG. 6, the electromagnet is adapted to be engaged by the boxed-shaped member 39 disposed at the free end of the arm member. At least such member is formed of steel or another magnetically permeable material adapted to be attracted by an electromagnet. Whenever the arm member in the embodiment shown in FIGS. 5 and 6 is desired to be retracted and maintained in the storage position, the electromagnet is energized and the rod member of the cylinder assembly is retracted to cause the arm member to displace rearwardly until section 39 engages the electromagnet which then functions to hold the arm member in the storage position. To move the arm member to an operative position, the electromagnet is simply de-energized and the rod member of the cylinder assembly is extended to displace the arm member to the desired angle relative to the handle.

In a still further embodiment of the present invention, there is provided a thumb assembly including an arm member pivotally connectable to the handle of a machine, a plurality of brackets connectable to and spaced along the underside of the handle and a rigid strut pivotally connected at one end to the arm member and connectable at the other end to a selected one of the brackets on the handle. The strut may be detachably connected to a selected one of the brackets by means of a connecting pin insertable through registered openings in the free end of the strut and an opening in a selected one of such brackets. The arm member of such embodiment also is provided with a pair of transversely spaced side wall sections which are adapted to at least partially receive the strut therebetween when the arm is in the storage position and the strut is connected to a rearwardly disposed bracket, causing the arm member to be in the storage position. The arm member of this embodiment may be either used independently or in cooperation with another implement such as a bucket as previously described to perform various ground working and material handling functions.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An assembly mountable on a maneuverable handle of a machine for performing various earth working and material handling functions comprising:

a first implement pivotally mountable on said handle;

a second implement pivotally mountable on said handle, cooperable with said first implement when said implements are mounted on said handle, and angularly displaceable between at least one extended operable position and a retracted, storage position;

a bracket mountable on said handle;

an extendable means operatively interconnecting said bracket and said second implement; and retaining means disposed on said bracket operatively engageable with said second implement for releaseably retaining said second implement in said storage position.

2. An assembly according to claim 1 wherein said retaining means comprises a latch mechanism.

3. An assembly according to claim 1 wherein said latch mechanism includes a latch member pivotally connected to said bracket, biasingly engaging said arm member when said arm member is in said storage position.

4. An assembly according to claim 3 including biasing means disposed between said bracket and said latch member, biasing said latch member, in a latching condition relative to said arm member.

5. An assembly according to claim 4 wherein a force exerted by said biasing means exceeds the load of the weight of said arm member and said extendable means.

6. An assembly according to claim 4 wherein said latch member includes a surface engageable by said arm member when said arm member is angularly displaced to the storage position thereof for camming said latch member out of a latching position, against the action of said biasing means.

7. An assembly according to claim 1 wherein said arm member includes a pair of transversely spaced, side wall sections, and wherein said extendable means is received at least partially between said side wall sections when said arm member is in said storage position.

8. An assembly according to claim 1 wherein said extendable means comprises a hydraulic cylinder assembly.

9. An assembly according to claim 1 wherein said extendable means is operable to position said arm member in selected extended positions.

10. An assembly according to claim 1 wherein said retaining means comprises an electromagnet and said arm member includes at least a portion thereof comprising a magnetically permeable material which may be attracted and held by said electromagnet.

11. An assembly according to claim 9 wherein said electromagnet is operable to be selectively energized and de-energized remotely by an operator of said machine.

12. An assembly mountable on a maneuverable handle of a machine for performing various work functions comprising:

an arm member pivotally mountable on said handle, angularly displaceable between extended, operable positions and a retracted storage position;

a bracket mountable on said handle;

an extendable assembly operatively interconnecting said bracket and said arm member; and retaining means disposed on said bracket engageable with said arm member for releaseably retaining said arm member in said storage position.

13. An assembly according to claim 12 when said retaining means comprises a latch mechanism.

14. An assembly according to claim 13 wherein said latch mechanism includes a latch member pivotally connected to said shaft, biasingly engaging said arm member when said arm member is in said storage position.

15. An assembly according to claim 14 including biasing means disposed between said bracket and said latch member, biasing said latch member in a latching condition relative to said arm member.

16. An assembly according to claim 14 wherein a force exerted by said biasing means exceeds a weight of said arm member and said extendable means.

17. An assembly according to claim 14 wherein said latch member includes a surface engageable by said arm member when said arm member is angularly displaced to the storage position thereof for camming said latch member out of a latching position, against an action of said biasing means.

18. An assembly according to claim 12 wherein said arm member includes a pair of transversely spaced, side wall sections, and wherein said extendable means is received at least partially between said side wall sections when said arm member is in said storage position.

19. An assembly according to claim 12 when said extendable means comprises a hydraulic cylinder assembly.

20. An assembly according to claim 12 wherein said extendable means is operable to position said arm member in selected extended positions.

21. An assembly according to claim 12 wherein said retaining means comprises an electromagnet and said arm member includes at least a portion thereof comprised of a magnetically permeable material which may be attracted by said electromagnet.

22. An assembly according to claim 21 wherein said electromagnet is operable to be selectively energized and de-energized remotely by an operator of said machine.

23. An assembly mountable on a maneuverable handle of a machine for performing various work functions comprising:

an arm member pivotally mountable on said handle, having a pair of transversely spaced, side wall sections and angularly displaceable between extended, operable positions and a retracted, storage position;

an extendable assembly operatively connectable to said handle and connected to said arm member; and wherein said extendable means is at least partially received between said side wall sections of said arm member when said arm member is disposed in said storage position to automatically position the arm member adjacent said handle.

24. An assembly mountable on a maneuverable handle for performing various work functions comprising:

an implement pivotally connectable to said handle, having a pair of transversely spaced, side wall sections and displaceable between extended, operable positions and a retracted storage position adjacent said handle;

a rigid link pivotally connected to said arm member between said side wall sections and connectable to a selected one of a set of connecting means on said handle; and wherein a strut is at least partially and automatically received within said side wall sections of said arm member when said arm member is connected to said handle and in said storage position and said strut is connected to a connecting means on said handle.

25. An assembly according to claim 24 wherein said connecting means comprises a plurality of brackets secured to and spaced along an underside of said handle, each having a connecting pin receiving opening therein, and wherein said strut is connectable to a selected one of said brackets by a connecting pin insertable between openings in said strut and one of said brackets.

* * * * *